US006299484B2

(12) United States Patent
Van Woensel

(10) Patent No.: US 6,299,484 B2
(45) Date of Patent: Oct. 9, 2001

(54) SHIELDED CONNECTOR

(75) Inventor: Johannes Maria Blasius Van Woensel, Rosmalen (NL)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/728,531

(22) Filed: Dec. 1, 2000

(30) Foreign Application Priority Data

Dec. 3, 1999 (NL) ..... 101374

(51) Int. Cl.[7] ..... H01R 13/648
(52) U.S. Cl. ..... 439/608
(58) Field of Search ..... 439/608, 607, 439/108, 609, 610, 79

(56) References Cited

U.S. PATENT DOCUMENTS

| | | | |
|---|---|---|---|
| 4,632,476 | 12/1986 | Schell | 339/14 R |
| 4,846,727 | 7/1989 | Glover et al. | 439/608 |
| 5,104,341 | 4/1992 | Gilissen et al. | 439/608 |
| 5,403,206 | 4/1995 | McNamara et al. | 439/608 |
| 5,496,183 | 3/1996 | Soes et al. | 439/79 |
| 5,620,340 | 4/1997 | Andrews | 439/608 |
| 5,632,635 | 5/1997 | Vanbesien et al. | 439/108 |
| 5,664,968 * | 9/1997 | Mickievicz | 439/608 |

FOREIGN PATENT DOCUMENTS

0746060 A2 12/1996 (EP) .

* cited by examiner

*Primary Examiner*—Tho D. Ta
(74) *Attorney, Agent, or Firm*—Perman & Green, LLP

(57) ABSTRACT

A connector comprises an insulating housing, a plurality of contact elements arranged in rows and columns in said housing, and at least one shielding plate arranged between two adjacent columns of contact elements. The shielding plate is a structurally separate part provided with fastening members and is attached only to one of the contact elements of a column of contacts due to the fastening members.

8 Claims, 5 Drawing Sheets

SHIELDED CONNECTOR

The invention relates to a connector comprising an insulating housing, a plurality of contact elements arranged in rows and columns in said housing, and at least one shielding plate arranged between two adjacent columns of contact elements, wherein the shielding plate is contacting one of the contact elements of a column of contacts.

U.S. Pat. No. 5,496,183 discloses a connector with shielding plates, wherein the shielding plates are prestressed to mount the shielding plate on the connector housing. The shielding plate is contacting a contact element by means of a contact spring. The shielding plate is further provided with two contact projections for making contact with grounding circuit traces of a printed circuit board.

EP-A-0 746 060 discloses a shielded back plane connector wherein shielding plates are provided having locking tabs and a separate contact spring for contacting a contact element. The shielding plate is further provided with two contact projections for contacting circuit traces of a printed circuit board.

Connectors with shielding plates arranged between adjacent columns of contact elements are further shown in U.S. Pat. Nos. 4,846,727 and 5,403,206.

U.S. Pat. No. 5,104,341 discloses a connector, wherein the shielding plate is provided with a contact spring contacting a face of a contact element opposite of the shielding plate. The shielding plate is further provided with a contact element for mating with a contact element of a mating connector and with a further contact element for connection to a printed circuit board. In this manner the shielding plate is electrically connected to ground through two terminals. Electrical connection and mechanical support of the shielding plate are provided by separate elements resulting in a complicated manufacturing of the shielding plate and moreover the shielding plate is mechanically supported at several locations increasing accuracy requirements. As in the other known connectors of this type, the shielding plate is a structurally integrated part of the connector having interconnections with the housing of the connector at a plurality of locations.

The invention aims to provide an improved connector of the above-mentioned type.

According to the invention a connector of the above-mentioned type is characterized in that the shielding plate is a structurally separate part provided with fastening means and is attached only to said one contact element by means of the fastening means.

In this manner a connector is obtained, wherein the shielding plate is mechanically supported on one of the contact elements of a column of contacts only without any relationship with any substrate on which the connector is mounted. Further the shielding plate is electrically connected to ground by a single terminal. Manufacturing the shielding plate is relatively simple as it is not necessary to form special receptacle-type or pin-type terminals as parts of the shielding plate.

According to an embodiment of the connector of the invention the shielding plate is provided with protruding tabs engaging said one contact element.

According to a preferred embodiment, each column of contact elements is accommodated in a separate insulating module housing having a plurality of openings extending through the module housing and at least partially exposing said one contact element, wherein the fastening means are attached to said one contact element through the openings.

The invention will be further explained by reference to the drawings in which some embodiments of the connector of the invention are shown.

Figure 2:
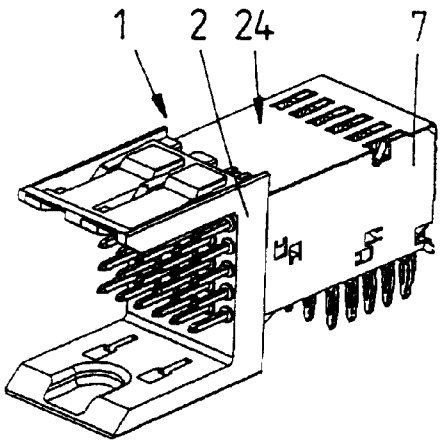
FIG. 2 is a perspective view of the connector of FIG. 1 as assembled.
Figure 1:
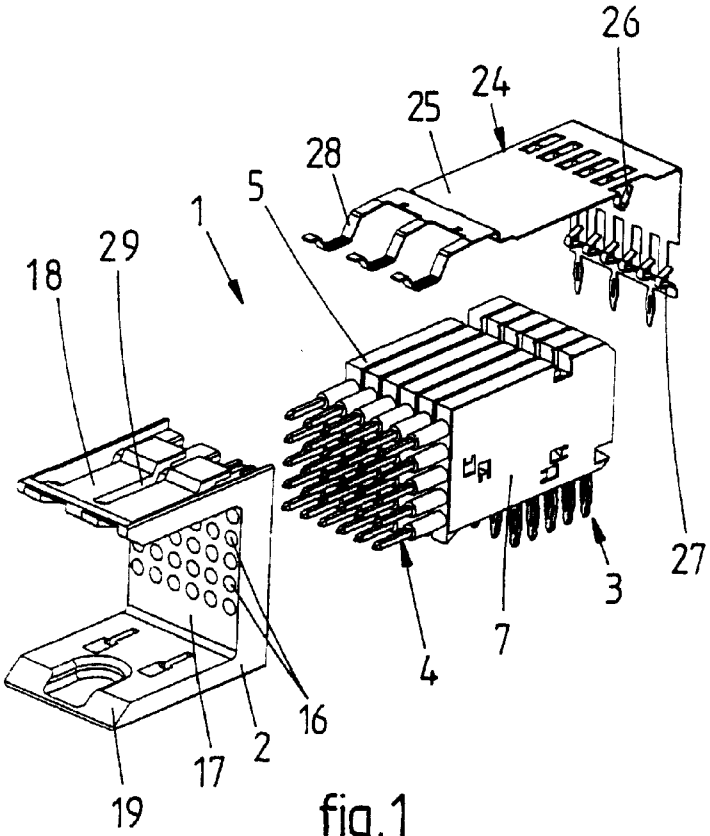
FIG. 1 is an exploded perspective view of a first embodiment of a connector of the invention of the header-type.
Figure 4:
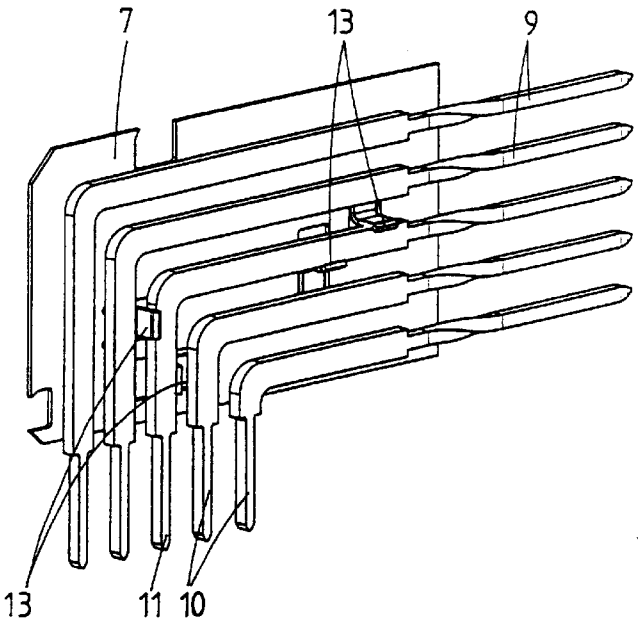
FIG. 4 is a perspective view of a column of contact elements, wherein the module housing is broken away to show the attachment of the shielding plate to the central contact element.

FIGS. 1 and 2 show a header-type connector 1, comprising insulating front and rear housing parts 2, 3 and a plurality of contact elements 4 regularly arranged in rows and columns as shown. Each column of contact elements 4 is overmoulded by a module housing 5 having four openings 6 which can best be seen in FIG. 3. The openings 6 extend laterally through the housing to allow attachment of a shielding plate 7 on one of the contact elements 4 of the column of contact elements of a module housing 5. The way of attaching the shielding plate 7 to a contact element 4 is shown in particular in FIGS. 3 and 4. In the embodiment of FIGS. 1–4, both ends of the contact elements 4 are pin-type.

Each contact element 4 comprises a first contact section 8 with a mating end 9 and a second contact section 10 with a connection end 11. In the embodiment shown in FIG. 1–4, the first and second contact sections 8, 10 are mutually perpendicular providing a right angle connector. In the connector described, the shielding plate 7 is firmly attached to the central contact element 4 by fastening means 12 only, which fastening means are made as tabs 13 embedding the contact element 4. The fastening tabs 13 also provide an electrical connection between the contact element 4 and the shielding plate 7. The tabs 13 are formed out of the shielding plate 7 and are therefore integral with the shielding plate. Two tabs 13 are engaging the first contact section 8 at opposite sides. In a similar manner two tabs 13 are engaging the second contact section 10 from opposite sides. The faces of the contact sections 8; 10 engaged are perpendicular to the plane of the shielding plate 7 and the contact force direction of all tabs 13 is parallel to the plane of the shielding plate 7. The tabs 13 have a restricted length resulting in a high engagement force. In this manner the shielding plate 7 is a separate part structurally independent from the connector housing but firmly attached to the contact element 4. A good electrical connection between the shielding plate and the contact element is guaranteed. The central contact element 4 of the column of contact elements functions as a ground terminal which provides the single ground terminal connecting the shielding plate 7 to ground. As a result the central contact element 4 is mechanically embedded at each section along the length of the element and the independent shielding plate is firmly held without any other structural interconnection to the housing of the connector. Further, this ground contact element 4 provides for a shielding between the upper and lower two signal contact elements 4. Of course in alternative embodiments other arrangements of ground and signal contact elements could be used.

Figure 3:
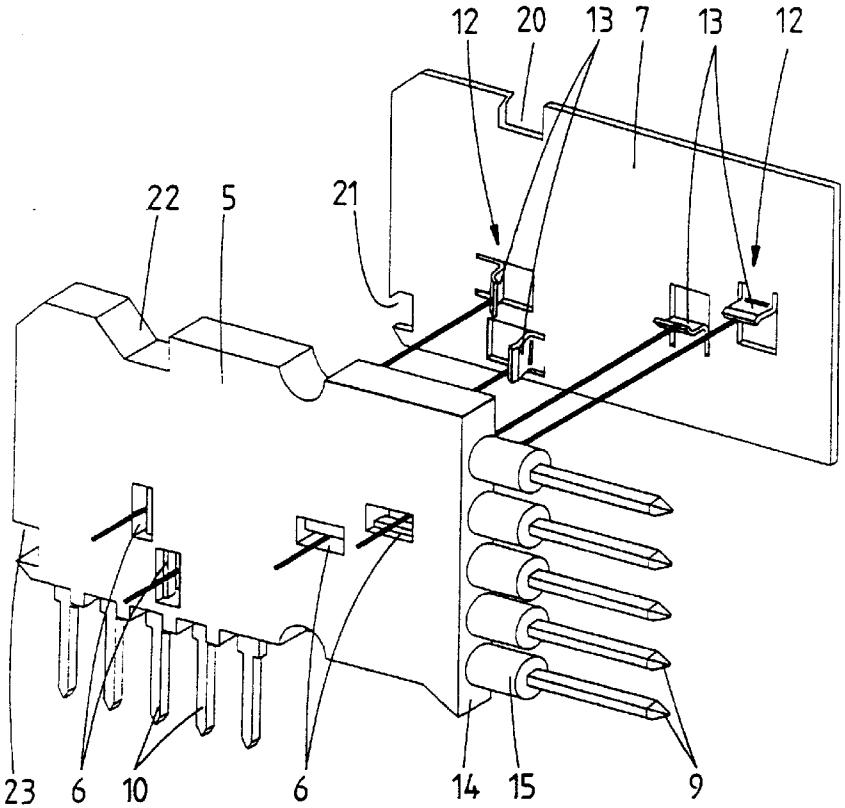
FIG. 3 is a perspective view of a module housing with one column of contact elements and a shielding plate of the connector of FIG. 1.
Figure 6:
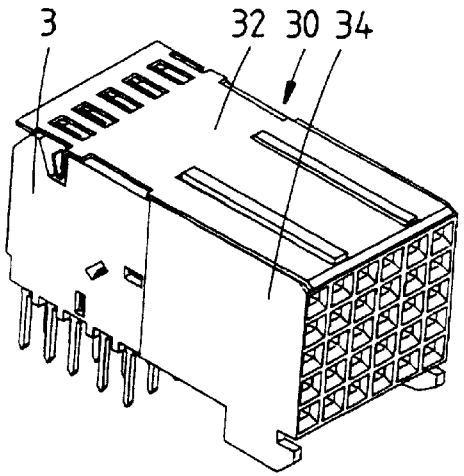
FIGS. 5–8 show a second embodiment of the connector of the invention of the receptacle-type in the same manner as in FIGS. 1–4.
Figure 5:
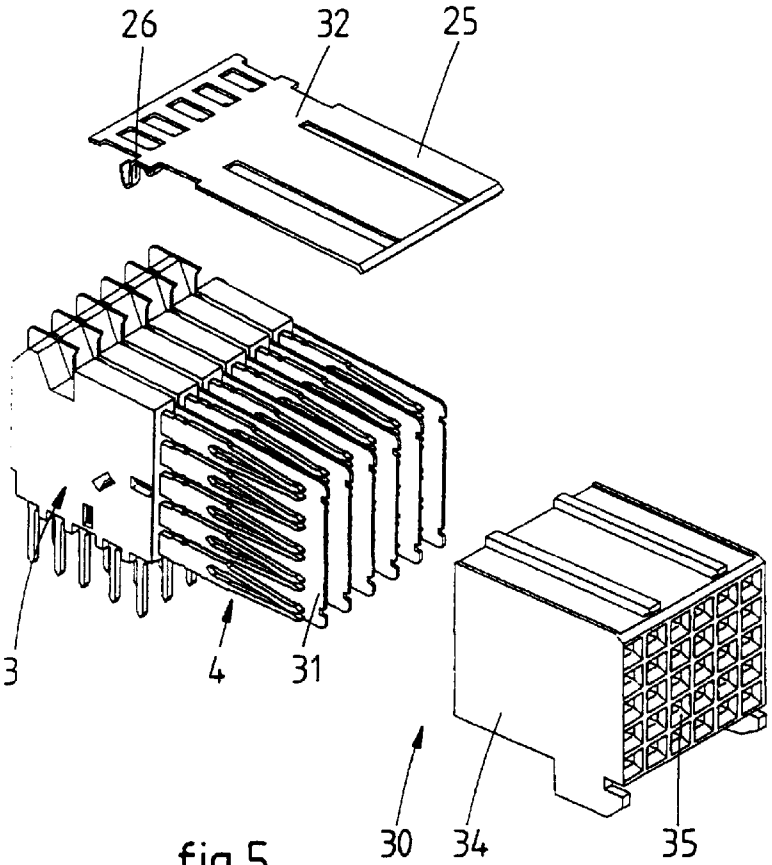

As shown in particular in FIG. 3, the module housing 5 is provided with a mating side 14 having cylindrical extensions 15 enclosing a part of the first contact sections 8. In manufacturing the connector 1, the shielding plates 7 are first attached to the central contact elements 4 to thereby mount the shielding plate 7 on the module housing 5. The module housing 5 together with the shielding plate 7 is connected to the front housing part 2 by inserting the cylindrical extensions 15 into a column of openings 16 of a base wall 17 of the front housing part 2. The base wall 17 has two upright side walls 18, 19 to provide the U-shaped front housing part 2.

In the embodiment of FIGS. 1–4, the shielding plate 7 is provided with an upper contact recess 20 and a rear contact recess 21. Corresponding recesses 22 and 23 are provided in the upper and rear sides of the module housing 5 and these recesses are aligned with the recesses 20, 21 of the shielding plate 7 when the shielding plate is mounted on the module housing 5. When the module housings 5 and the front housing part 2 have been interconnected, a shielding member 24 is mounted on the assembled connector housing 2, 5 covering the upper and rear sides of all module housings 5. The shielding member 24 includes an upper planar section 25 having a plurality of first contact springs 26 formed out of the upper planar section. These first contact springs 26 project into the aligned recesses 18, 20 and contact the shielding plates 7 in these recesses as the bottom of the shielding plate recess 20 is located above the bottom of module housing recess 22.

The shielding member 24 further includes a rear planar section with second contact springs formed out of the rear planar section. These second contact springs 27 project into the aligned recesses 21, 23 and contact the shielding plates 7 in the same manner as the first contact springs 26.

Further the shielding member 24 is provided with third contact springs 28 which are received in slots 29 of the side wall 18 of the front housing part 2. These third contact springs 28 are adapted to contact the shielding plate of a mating connector inserted into the receiving space of the front housing part 5.

Figure 8:
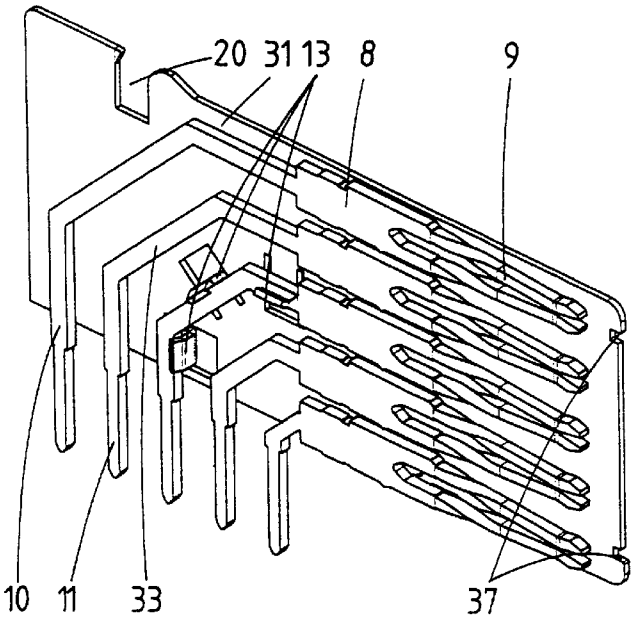
Figure 7:
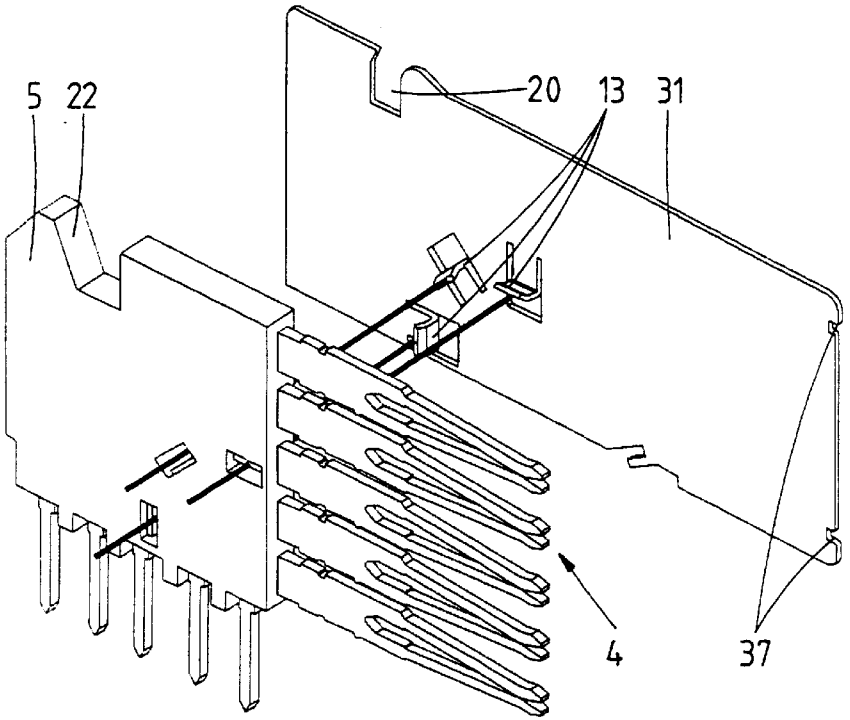

FIGS. 5–8 show a receptacle-type connector 30 which is mainly made in the same manner as connector 1 of FIGS. 1–4. Corresponding parts are indicated by the same reference numerals. In this embodiment a shielding plate 31 is used not only covering the module housing 5 but also extending along the first contact sections 8 projecting out of the module housing 5. Both the shielding plate 31 and the module housing 5 are provided with an upper recess 20 and 22, respectively, only. In a corresponding manner a shielding member 32 is used having an upper planar section 25 only with first contact springs 26 contacting the shielding plates 31 in the upper contact recesses 20. As shown in FIGS. 7 and 8 in particular, the shielding plates 31 are provided with three tabs 13 as fastening means. The contact elements 4 are provided with a third contact section 33, wherein each contact section 8, 10 and 33 is engaged by one tab 13 only. In the same manner as in the embodiment of FIGS. 1–4, the contact force direction is parallel to the plane of the shielding plate 31 which together with the short length of the tabs 13 results in a high engagement force. The connector 30 comprises a front housing part 34 with a mating side 35 having an array of openings 36 for receiving contact pins. The projecting parts of the shielding plates 31 are received in slots of the front housing part 34. The front edge of the shielding plate 31 is provided with two recesses 37 for locating the shielding plate 31 inside of the front housing part 34.

Figure 9:
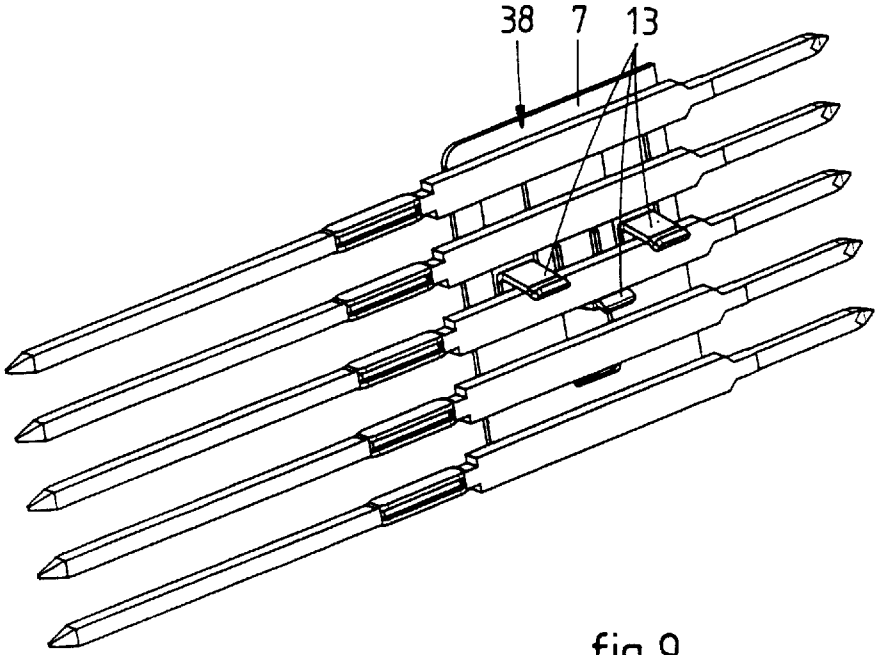
FIG. 9 shows a further embodiment of one column of contact elements with shielding plate attached to the central contact element.

The connectors 1 and 30 can be mated to interconnect printed circuit boards or the like. Of course, other embodiments of the connectors are possible. For example, a straight header-type connector can be made in the same manner. FIG. 9 shows in the same manner as FIG. 4 one column of straight contact elements 38, wherein the central contact element supports the shielding plate 7. Further, the receptacle-type connector can be made straight instead of right-angled.

Figure 10:
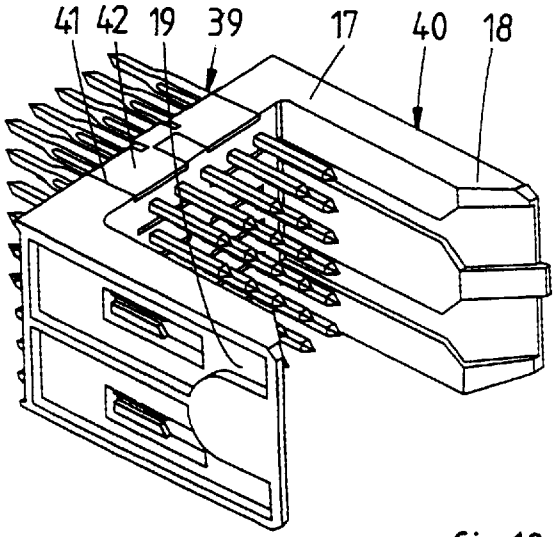
FIG. 10 shows a perspective view of a further embodiment of the connector of the invention of the header-type.
Figure 11:
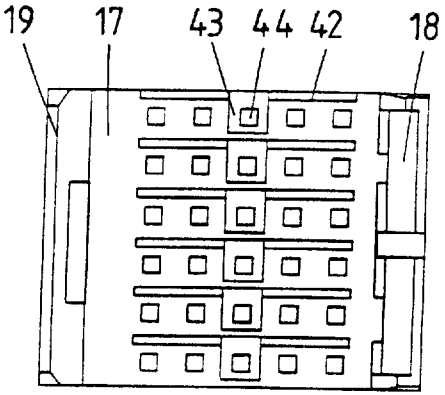
FIG. 11 shows a bottom view of the connector of FIG. 10.

A further embodiment of a straight header-type connector is shown in FIGS. 10 and 11. In this case contact pins 39 are mounted in rows and columns in a housing 40 in a conventional manner. The housing 40 is provided with base and side walls 17–19 in the same manner as the front housing part 2. However, the base wall 17 is provided with slots 41 and shielding plates 42 are mounted in these slots. Each shielding plate 42 is provided with a lateral tab 43. The tab 43 has an opening 44 for engaging the central contact pin 39.

It will be understood that the invention provides a connector, wherein the shielding plate is mechanically supported on one of the contact elements of a column of contacts only without any relationship with any substrate to which the contact elements is connected. Further the shielding plate is electrically connected to ground by a single terminal. Manufacturing the shielding plate is relatively simple as it is not necessary to form special receptacle-type or pin-type terminals as parts of the shielding plate. The contact force direction of the fastening means is parallel to the plane of the shielding plate. In this manner the shielding plate is firmly attached to the contact element and a good electrical connection between the shielding plate and the contact element is guaranteed.

The invention is not restricted to the above described embodiments which can be varied in a number of ways within the scope of the claims.

What is claimed is:

1. Connector comprising an insulating housing, a plurality of contact elements arranged in rows and columns in said housing, and at least one shielding plate arranged between two adjacent columns of the contact elements, wherein the shielding plate is contacting one of the contact elements of a column of contacts, wherein the shielding plate is a structurally separate part provided with fastening means and is attached only to said one of the contact elements at several points due to the fastening means.

2. Connector according to claim 1 wherein each column of contact elements is accommodated in a separate insulating module housing having a plurality of openings extending through the module housing and at least partially exposing said one contact element, wherein the fastening means are attached to said one contact element through the openings.

3. Connector according to claim 1, wherein the shielding plate is provided with said fastening means in the form of protruding tabs engaging said one contact element.

4. Connector according to claim 3, wherein successive protruding tabs are engaging said one contact element from opposite directions.

5. Connector according to claim 3, wherein tabs are formed out of said shielding plate.

6. Connector according to claim 1, wherein each contact element is provided with a mating contact end and a connection end, the mating contact end and connection end being mutually perpendicular, wherein the fastening means attach said shielding plate both to a first contact element section aligned with the mating contact end and a second contact element section aligned with the connection end.

7. Connector according to claim 6, wherein the fastening means comprise two tabs engaging opposite sides of the first contact element section and two tabs engaging opposite sides of the second contact element section.

8. Connector according to claim 6, wherein each contact element comprises a third contact element section extending obliquely between the first and second contact element sections, wherein the fastening means comprises three tabs each tab engaging one contact element section.

* * * * *